United States Patent [19]

Goldner

[11] 4,449,438

[45] May 22, 1984

[54] MUTE FOR STRINGED INSTRUMENTS

[76] Inventor: Richard Goldner, 3717 Toad Lake Rd., Bellingham, Wash. 98225

[21] Appl. No.: 416,984

[22] Filed: Sep. 13, 1982

[51] Int. Cl.[3] ..... G10D 3/04

[52] U.S. Cl. ..... 84/310

[58] Field of Search ..... 84/310

[56] References Cited

U.S. PATENT DOCUMENTS

| | | | |
|---|---|---|---|
| 2,483,268 | 9/1949 | Fawick | 84/310 |
| 2,863,350 | 12/1958 | Si-Hon Ma | 84/310 |
| 3,994,196 | 11/1976 | Hamil | 84/310 X |

FOREIGN PATENT DOCUMENTS

| | | | |
|---|---|---|---|
| 20522 | of 1908 | United Kingdom | 84/310 |

*Primary Examiner*—Lawrence R. Franklin

*Attorney, Agent, or Firm*—Reed, Smith, Shaw & McClay

[57] ABSTRACT

The present invention relates to an improved mute which is used for stringed instruments. The invention comprises a holder and a first engaging surface for engaging a major surface of the bridge of a stringed instrument such as a violin. At least one second engaging surface is provided which is movably positioned relative to the first engaging surface such that it may abut either the other engaging surface or the opposite major surface of the bridge. Means are provided for mounting the engaging surfaces to the holder so that they are generally in a facing, movable and pivotable relationship to one another. Means are also provided for biasing the first engaging surface toward the second engaging surface with sufficient force to retain the mute on the bridge.

10 Claims, 7 Drawing Figures

MUTE FOR STRINGED INSTRUMENTS

BACKGROUND OF THE INVENTION

1. Field of the Invention

The present invention relates to a device for the muting of the sound of stringed instruments and, in particular, to an improved mute which overcomes the disadvantages inherent in prior art muting devices.

2. Discussion of the Technical Problem

The muting of the sound of stringed instruments is an effect in musical performance frequently used by composers. Muting is achieved by partially impeding the transmission of the energy of the oscillating strings through the bridge of the resonating body of the instrument. Muting is achieved by temporarily (for the duration of the muted effect) increasing the mass of the bridge by adding to such bridge a muting device. Such devices are well known to musicians of stringed instruments.

Typically, muting devices comprise either a prong-like structure which is wedged onto the bridge of the string instrument or a device which is slideably attached to the strings between the bridge and the tail piece so as to permanently remain on the instrument. Both types of devices have serious disadvantages. The prong-like structures must be firmly wedged over the bridge so as not to "buzz" or rattle during the playing of the instrument. Care must be taken so that none of the prongs contact any of the strings. Also, there is the danger that the continuous vibration of the bridge, particularly during the playing of double stops or chords, will loosen the wedge grip causing an annoying buzzing or rattling of the prong. Since most bridges are tapered from bottom to top it is common for such prong type mutes to become unfixed from the bridge and rattle. It is also common for prong type devices to project rather high over the bridge subjecting them to frequent dislodgement by the bow hand of the musician during play.

Mutes which are slideably attached to the strings between the bridge and the tail piece are generally more convenient and have negligible projection above the bridge so that they are not readily dislodged or knocked off by the bow hand of a musician. However, such devices have a considerable disadvantage in that the frequent sliding on the strings to achieve the muted effect is destructive of the string windings. Is is not uncommon during the playing of the instrument to carelessly move the device so as to either dislodge it or knock down the bridge resulting in serious damage to the stringed instrument.

Other types of mutes, mostly made from rubber, have to be forced on to the instrument strings between the bridge and tail piece through a fine cut in the rubber. Apart from the cumbersome operation of putting on this type of mute and taking it off, it also has the annoying disadvantage when not wedged onto the bridge of often dangling freely from the instrument string and thus buzzing and rattling.

All known mutes which are designed to stradle the bridge have the intrinsic disadvantage of not exactly conforming to the various thicknesses and tapers of different bridges. Either the distance between the prongs is too large, in which case the mute will sit too loosely on some bridges, or if the distance is too small, the prongs will be spread apart when the mute is forced onto the bridge, in which case contact between the prongs and the bridge surfaces will be lost at either the points of the prongs or the base of the prongs. Ideally, for the best acoustic results, the prongs should automatically adjust to any thickness and taper of any bridge so as to remain snuggly and completely in contact with both surfaces of the bridge. The present invention achieves this objective.

It is, therefore, an object of the present invention to overcome the disadvantages associated with conventional mute devices and to provide a mute which affords beautifully muted sounds while retaining the intrinsic quality of the instrument itself. A further object of the present invention is to provide a mute which is easily placed on or removed from the bridge of the stringed instrument and which maintains a very low projection with respect to said bridge. The quality and degree of muting can be precisely effected by the mass and configuration of the mute. It is a further object of the present invention to provide a mute which automatically centers and stabilizes so as to avoid touching any of the strings in the playing area while retaining full engagement with the bridge even during the heaviest playing of double stops and chords. A further object of the present invention is to provide a mute which can, if desired, have multiple selected degrees and/or timbers of muting; e.g., one side for light and the other for heavy muting.

Still another objective is to design a mute such that it can remain permanently on the instrument, can be safely guided from a resting position near the tail piece to the operative position on the bridge and also can be removed from the instrument in a split second. The fast and easy removal is desirable because most soloists prefer to be able to remove a mute from the instrument for pieces of music which do not require a mute.

SUMMARY OF THE INVENTION

The present invention provides a mute which easily fits onto the bridge of stringed instruments. Generally, the present invention provides a mute which comprises a holder and a first engaging surface that is adapted to engage or grip a major surface of a bridge. A second engaging surface is provided which is movably positionable such that it may abut either the first engaging surface or the opposite major surface of the instrument bridge. A means is provided for mounting the first and second engaging surfaces to the holder. A biasing means is attached to the holder such that the first and second engaging surfaces are biased toward one another with sufficient force to retain the mute on the bridge and to adapt the orientation of the first and second engaging surfaces to the orientation of the two major surfaces of the bridge.

In a presently preferred embodiment of the invention the holder includes a pair of engaging surfaces. Additionally the holder contains a slot extending transverse to its pair of engaging surfaces. Into the slot is inserted a member with two additional engaging surfaces either of which is adapted to abut a major surface of the instrument bridge. The lower extremity of the inserted member may have an elongated dimension transverse to the longitudinal direction of the instrument strings which exceeds the spacing between adjacent strings to facilitate the positioning of the mute. A biasing means comprising a double-back resilent strip may be retained in the holder by engagement with the transverse slot to bias engaging surfaces of the inserted member toward facing engaging surfaces of the holder to secure the mute onto the bridge.

In another embodiment the invention provides a mute which comprises a holder including a first engaging surface adapted to engage or grip a major surface of the bridge. A second engaging surface is movably positioned within the holder such that it may abut the first engaging surface of the holder or the opposite major surface the instrument bridge. A biasing means is confined within the holder to bias the second engaging surface towards the first engaging surface to clamp the mute onto the instrument bridge. A confining means is included to confine the biasing means and the second engaging surface within the holder. The confining means permits pivotal movement of the second engaging surface within the holder such that it may automatically be oriented parallel to its engaged major surface of the instrument bridge, but not necessarily parallel to the first engaging surface.

In various embodiments of the present invention it is preferable to include facilities for controllably adding mass to the mute to control the degree of muting which results. Accordingly the mute, which is normally fabricated from an elastomeric or plastic material, may have additional mass in the form of metal embedded in the member containing the second engaging surface of the mute. In the case where two movable engaging surface supporting members are utilized, the added masses may be different for each to provide the different degrees of muting described above. Further, because the mutes according to the present invention may be physically quite small, heavy muting may be achieved by adding mass to the engaging surfaces which are attached to the holder.

The mutes of the present invention provide a most beautiful muted sound which retains the intrinsic quality of the stringed instrument. The small size, pivotable orientation of engaging surfaces, and secure retention characteristics due to the biasing means provides a mute that retains full engagement with the instrument bridge during periods of heaviest playing such as double stops and chords. Other advantages of the present invention will become apparent from a perusal of the following description of the presently preferred embodiments of the present invention taken in connection with the drawings.

PRESENTLY PREFERRED EMBODIMENTS OF THE INVENTION

Figure 1:
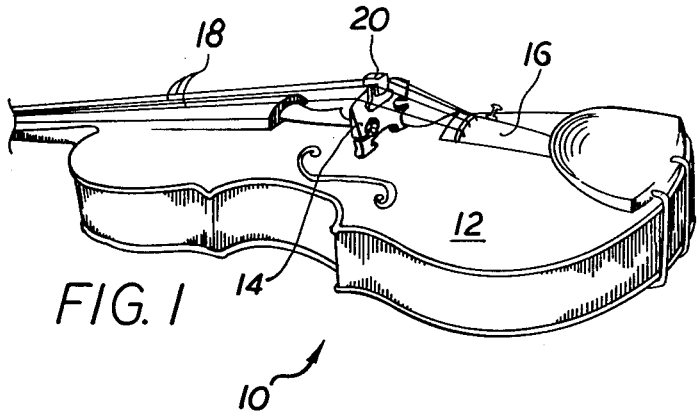
FIG. 1 is an perspective view of a violin showing the placement of a mute on the violin bridge in accordance with the present invention.
Figure 2:
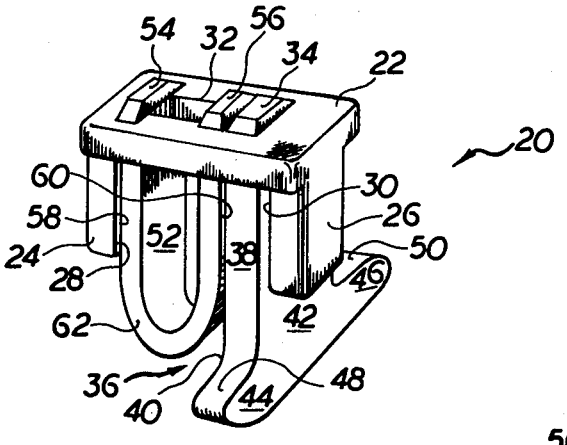
FIG. 2 is a perspective side view of a preferred embodiment of the mute in accordance with the present invention.

Referring to FIG. 1, a violin 10 is shown, including a resonating body portion 12, a bridge 14, a tail piece 16, and a plurality of strings 18 extended longitudinally thereacross. A mute 20 according to the present invention is shown in its operational position atop the bridge 14 of violin 10. With reference also to FIG. 2, mute 20 includes a holder 22 having a pair of opposed arms 24 and 26 depending therefrom. Arms 24 and 26 form and support a pair of facing engaging surfaces 28 and 30, respectively, which are adapted to grip the bridge 14. Within the top section of holder 22 between opposed arms 24 and 26 is an elongated transverse slot 32. A tab end portion 34 of an engaging member 36 is inserted and retained in slot 32. Engaging member 36 also includes a body portion 38 which forms and supports a pair of opposed surfaces 40 and 42, oriented to face engaging surfaces 28 and 30, respectively, and a pair of lower protrusions 44 and 46 which extend in a direction generally normal to the strings 18 when the mute 20 is engaged to bridge 14 in its operational position. Protrusions 44 and 46 each include an upper guide surface 48 and 50, respectively, for purposes to be discussed more fully below.

Biasing means 52 is secured to holder 22 between arms 24 and 26 in any convenient manner. For example, as best shown in FIG. 2, biasing means 52 may comprise a doubled-back elongated strip of resilient material, e.g., rubber or plastic, having a pair of tabs 54 and 56 at the ends thereof for insertion and retention in slot 32. Of course, biasing means 52 may also comprise other conventional spring-like mechanisms conveniently oriented between arms 24 and 26. Biasing means 52 forms and supports a pair of oppositely facing engaging surfaces 58 and 60, and serves to simultaneously bias:

(1) engaging surface 28 toward engaging surface 58;
(2) engaging surface 60 toward engaging surface 40; and
(3) engaging surface 42 toward engaging surface 30.

Figure 3:
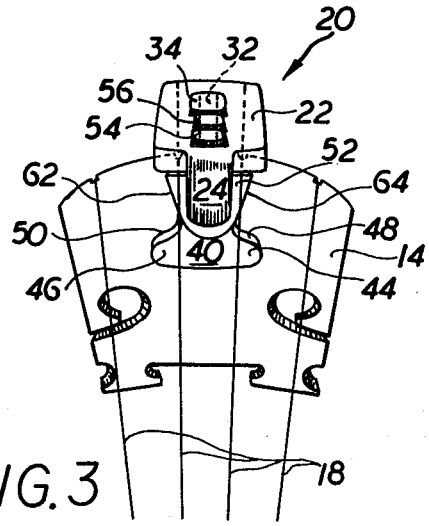
FIG. 3 is an elevated end view of the mute shown in FIG. 2 attached to a violin bridge.

Preferably, and for purposes to be discussed more fully below, biasing means 52 also includes radiused edge surfaces 62 and 64 generally normal to engaging surfaces 58 and 60, as best shown in FIG. 3.

With continued reference to FIGS. 1–3, during play the mute 20 is commonly oriented in one of two stationary positions; an operational position atop the bridge 14 as best shown in FIGS. 1 and 3, and a rest or non-operational position (not shown) adjacent the tail piece 16 of violin 10.

Initially, the mute 20 is generally associated to the violin 10 by turning the mute 20 so that protrusions 44 and 46 of engaging member 36 extend generally parallel to strings 10, inserting protrusions 44 and 46 between and below adjacent selected ones of strings 18, and turning mute 20 again to the general relative orientation shown in FIG. 1, whereby the extension of protrusions 44 and 46 to a distance greater than the distance between adjacent ones of strings 18 loosely retains mute 20 in position on violin 10. During such a loose retention, the mute 20 conveniently adopts a position adjacent the tail piece 16 due to the downward slope of strings 18, which position is herein referred to as the rest position. The mute 20 provides no muting effect while in the rest position, maintains a low profile to avoid disruption of play, and remains conveniently available for rapid deployment into its operational position without requiring the player to divert his eyes to determine its position.

More particularly, to adjust the mute 20 from its rest position to the operational position shown in FIGS. 1 and 3, a player familiar with the operation of mute 20 may quickly reach to the rest position, grasp the mute 20 adjacent holder 22, and controllably move mute 20 toward bridge 14 with the upper guide surfaces 48 and 50 of engaging member 36 sliding along the lower surfaces of adjacent ones of strings 18. Thus, the mute 20 is maintained automatically between the selected strings 18 during its course from the rest position toward the operational position and is prevented from being inadvertently pulled off the instrument by the action of the guide surfaces 48 and 50. Since the engaging member 36 is preferably formed of a resilient rubber or plastic material, no danger exists of damaging strings 18 during the passage of guide surfaces 48 and 50 thereacross.

Upon approaching the operational position from the rest position, a player conveniently raises the mute 20 sufficiently to enable the arm 24 to pass over and beyond bridge 14, and thereafter lowers the mute 20 to bias the bridge 14 between one of the three available sets of facing engaging surfaces; 28–58, 60–40, or 42–30. (Of course, if engaging surface-set 42–30 is desired, the mute 20 should originally be positioned on violin 10 facing in a direction opposite the direction if engaging surface-sets or 28–58 or 60–40 are preferred.) In this regard it should be appreciated that mute 20 in accordance with the present invention includes the distinct advantage of providing a plurality of different degrees of muting effect from the same device. This is accomplished conveniently by providing each of the engaging surface-sets with differing amounts of contact areas with the major surfaces of bridge 14. Particularly, it can be appreciated from FIG. 2 that the contact area provided by engaging surface-set 60–40 is greater than that provided by engaging surface-set 42–30, which in turn is greater than that provided by engaging surface-set 28–58. Accordingly, a player is provided with great flexibility in selecting the degree of muting desired.

Upon biasing a selected engaging surface-set over the bridge 14, the mute 20 conveniently automatically centers itself between its adjacent strings 18 through the action of the radiused edge surfaces 62 and 64 of biasing means 52.

With continued reference to FIGS. 2 and 3, it will be appreciated that both engaging member 36 and biasing means 52 are so retained within slot 32 that each is movable both longitudinally and pivotally relative to holder 22. Accordingly, each of the three engaging surface-sets 28–58, 60–40, and 42–30 are automatically pivotally alignable with the major surfaces of bridge 14 when engaged thereto. As mentioned before, the major surfaces of a bridge 14 are commonly not parallel to each other, and different bridges have differing degrees of angular relationship between major surfaces. According to the present invention, due to the pivotable characteristics of engaging member 36 and biasing means 52, any selected engaging surface set automatically aligns itself with the angular relationship of the major surfaces of the bridge to which it is engaged, thereby assuring full contact area engagement with a resulting consistent degree of muting effect and an assured level of frictional engagement to the bridge to avoid inadvertent disengagement of the mute 20 during vigorous play.

Figure 4:
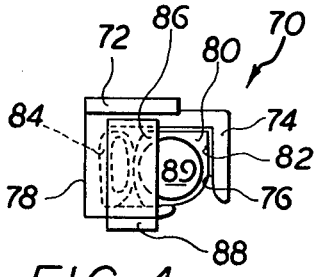
FIG. 4 is a side view of a mute according to the present invention having a single slideable and pivotable member supporting a bridge engaging surface.
Figure 5:
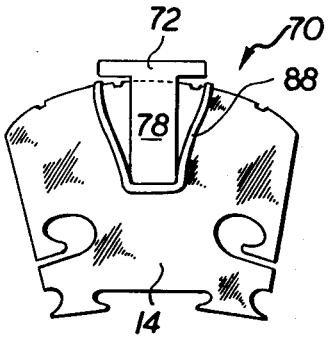
FIG. 5 is an end view of the mute shown in FIG. 4 attached to a violin bridge.
Figure 6:
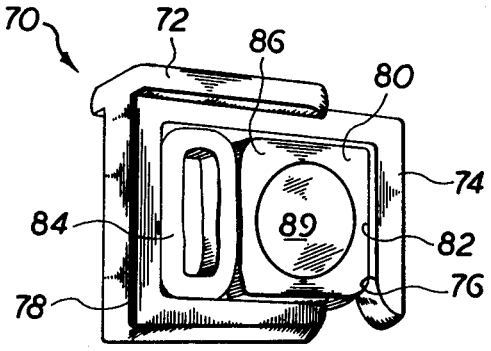
FIG. 6 is a perspective view of the mute shown in FIG. 4 with the confining means removed for purposes of clarity.

With reference to FIGS. 4–6, a second embodiment of the invention is shown, including a mute 70 having a holder 72 from which an arm 74 depends. Arm 74 forms and supports an engaging surface 76 on its inboard side. A second, generally L-shaped arm 78 also depends from holder 72 opposite from arm 74, to movably and pivotally retain an insert member 80 therebetween. Insert member 80 forms and supports an engaging surface 82 in facing relation to engaging surface 76, and biasing means 84 is positioned between arm 78 and insert member 80 to bias engaging surface 82 toward engaging surface 76.

In a preferred embodiment of the invention, engaging surfaces 76 and 82 each include radiused lower edge portions to facilitate the sliding entry of a bridge 14 therebetween, and also preferably insert member 80 includes additional radiused corner portions, e.g., corner 86, to facilitate pivotal motion thereof within the confines of arm 78 and holder 72. Although not limiting to the invention, biasing means 84 may be conveniently formed of a section of resilient tubing material of a suitable dimension.

As shown in FIGS. 4 and 5, mute 70 also includes confining means 88 which conveniently snaps onto the lower section of arm 78 and retains the insert member 80 and biasing means 84 within the confines of holder 72 and arm 78, while not limiting pivotal or longitudinal movement thereof.

A weighted element 89 may be interchangably mounted within the inserted member 80, whereby its mass and thereby the degree of muting effect realized may be conveniently adjusted. Alternatively, a plurality of insert members 80, each having different mass, may be conveniently provided to alter the degree of muting achieved.

In operation, as best shown in FIG. 5, the mute 70 is conveniently mounted on the instrument by biasing the major surfaces of bridge 14 between engaging surfaces 76 and 82, with the characteristic cross sectional configuration of confing means 88 being provided to avoid undesirable engagement with adjacent strings. As previously mentioned, the common non-parallel orientation of the major surfaces of bridge 14 presents troublesome difficulties. According to the present embodiment of the invention, the angular orientation of the engaging surfaces 76 and 82 automatically align with the major surfaces of the bridge 14 due to the interaction between biasing means 84 and the pivotal mounting of the insert member 80 within the mute 70. In this manner, full surface contact may be maintained with the major surfaces of bridge 14, thereby assuring consistent degrees of muting with different bridges and providing secure retention characteristics.

Figure 7:
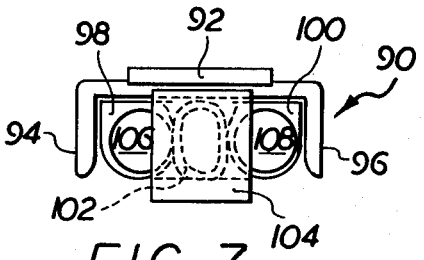
FIG. 7 is a mute according to the present invention having a pair of slideable and pivotable members, each supporting engaging surfaces to provide two degrees of muting.

With reference to FIG. 7, a third embodiment of the invention is shown, including a mute 90 having a holder 92, a pair of depending arms 94 and 96, a pair of insert member 98 and 100, and a biasing means 102 positioned between insert members 98 and 100 to bias each toward its adjacent arm 94 and 96, respectively. A confining means 104 is provided to retain the insert members 98 and 100 and biasing means 102 in position relative to holder 92. In like manner to mute 70 of FIGS. 4–6, each of insert members 98 and 100 are movably and pivotally mounted, whereby two alternative sets of bridge engaging surfaces exist. Differing degrees of muting effect may be thus, provided by varying the masses of weighted elements 106 and 108 which are positioned within insert members 98 and 100, respectively.

Of course, while presently preferred embodiments of the invention have been shown and described in particularity, the invention is not intended to be limited, except by the claims which follow.

What is claimed is:

1. A device for muting the sound produced by a stringed instrument having a bridge member and a tall piece comprising:

a holder;

a first engaging surface for engaging a first major surface of said bridge member;

a second engaging surface for engaging a second major surface of said bridge member;

means for mounting said first and second engaging surfaces to said holder in a generally facing, movable and pivotable relation one to another; and means mounted to said holder for biasing said first and second engaging surfaces toward one another with a force sufficient to retain said device on said bridge member and adapt the orientation of said first and second engaging surfaces to the orientation of said first and second major surfaces of said bridge member, respectively.

2. The device as set forth in claim 1, wherein said second engaging surface is movably mounted and wherein said biasing means acts to bias said second engaging surface toward said first engaging surface.

3. The device as set forth in claim 2, wherein said mounting means retains said biasing to said holder.

4. The device as set forth in claim 3, wherein said mounting means includes: slot means extending in said holder transverse to said first and second engaging surfaces; and slidable connector means for slidably connecting said second engaging surface to said slot means.

5. The device as set forth in claim 4, further comprising:

guide means for retaining said device between adjacent strings of said stringed instruments as it is manually moved from a rest position adjacent said tail piece to an operational position on said bridge member.

6. The device as set forth in claim 5, further comprising: centering means for positioning said device centrally between adjacent strings when engaged to said bridge member.

7. The device as set forth in claim 6, wherein said guide means comprises:

a lower extremity of said second engaging surface, said lower extremity having a dimension transverse to the longitudinal direction of said strings which exceeds the spacing between adjacent strings, said lower extremity slidable along the underside of said strings to provide guidance as said device is moved from said rest position toward said operational position and providing additional surface contact area with said bridge member in said operational position.

8. The device as set forth in claim 7, wherein said biasing means comprises a double-back resilient strip, said resilient strip including an appropriately dimensioned and radiused exposed surface transverse to said engaging surfaces to provide said centering means.

9. The device as set forth in claim 1 or 8, further comprising a third engaging surface and a fourth engaging surface mounted to said holder in a generally facing, movable and pivotably biased relation one to another for engaging said first and second major surfaces of said bridge member, respectively.

10. The device as set for in claim 9, wherein said third and fourth engaging surfaces provide a different measure of muting when engaged to said bridge member than said first and second engaging surfaces provide.

* * * * *

UNITED STATES PATENT AND TRADEMARK OFFICE

CERTIFICATE OF CORRECTION

PATENT NO. : 4,449,438

DATED : May 22, 1984

INVENTOR(S) : RICHARD GOLDNER

It is certified that error appears in the above-identified patent and that said Letters Patent are hereby corrected as shown below:

Column 7, line 7, after "bridge member and a" delete "tall" and substitute therefor -- tail --.

Signed and Sealed this

*Ninth* Day of *October 1984*

[SEAL]

*Attest:*

GERALD J. MOSSINGHOFF

*Attesting Officer*

*Commissioner of Patents and Trademarks*